US008681061B2

(12) United States Patent
Montgomery et al.

(10) Patent No.: US 8,681,061 B2
(45) Date of Patent: Mar. 25, 2014

(54) DETACHABLE ANTENNA FOR RADIO COMMUNICATIONS DEVICE

(75) Inventors: Mark T. Montgomery, Melbourne Beach, FL (US); Frank M. Caimi, Vero Beach, FL (US); Paul A. Tornatta, Jr., Melbourne, FL (US); Kyle D. Brink, Rockledge, FL (US)

(73) Assignee: Skycross, Inc., Fremont, CA (US)

( * ) Notice: Subject to any disclaimer, the term of this patent is extended or adjusted under 35 U.S.C. 154(b) by 174 days.

(21) Appl. No.: 13/308,695

(22) Filed: Dec. 1, 2011

(65) Prior Publication Data

US 2012/0306715 A1 Dec. 6, 2012

Related U.S. Application Data

(60) Provisional application No. 61/419,075, filed on Dec. 2, 2010.

(51) Int. Cl.
*H01Q 1/24* (2006.01)
*H01Q 9/16* (2006.01)

(52) U.S. Cl.
USPC ..... 343/702; 343/801; 343/810

(58) Field of Classification Search
USPC ..... 343/702, 801, 810
See application file for complete search history.

(56) References Cited

U.S. PATENT DOCUMENTS

| | | | | |
|---|---|---|---|---|
| 5,940,038 | A * | 8/1999 | Brown | 343/702 |
| 6,847,330 | B2 * | 1/2005 | Rada et al. | 343/702 |
| 7,579,993 | B2 * | 8/2009 | Lev et al. | 343/702 |
| 2005/0037709 | A1 | 2/2005 | Hwang | |
| 2005/0219140 | A1 | 10/2005 | Browne et al. | |
| 2008/0165066 | A1 | 7/2008 | Tiscareno et al. | |

OTHER PUBLICATIONS

International Search Report and Written Opinion for PCT/US2011/062777, dated Jul. 11, 2012.

* cited by examiner

*Primary Examiner* — Hoang V Nguyen
(74) *Attorney, Agent, or Firm* — Guntin & Gust, PLC; Ed Guntin

(57) ABSTRACT

A radio communications device includes a base unit having an enclosure and a radio system inside the enclosure. The device also includes an antenna unit detachably connected to the enclosure of the base unit. The antenna unit includes one or more antennas, each having an electrical radio frequency (RF) connection to the radio system via a non-conductive coupling through the enclosure.

22 Claims, 8 Drawing Sheets

DETACHABLE ANTENNA FOR RADIO COMMUNICATIONS DEVICE

CROSS REFERENCE TO RELATED APPLICATIONS

This application claims priority from U.S. Provisional Patent Application No. 61/419,075, filed on Dec. 2, 2010, entitled DETACHABLE ANTENNA FOR RADIO COMMUNICATIONS DEVICE, which is hereby incorporated by reference.

BACKGROUND

The present application relates generally to radio communications devices and, more particularly, to a radio communications device having a detachable external antenna. Such devices can be used for various purposes including, e.g., providing connectivity to networks using WiMAX and other telecommunications protocols.

BRIEF SUMMARY OF THE DISCLOSURE

A radio communications device in accordance with one or more embodiments includes a base unit having an enclosure and a radio system inside the enclosure. The device also includes an antenna unit detachably connected to the enclosure of the base unit. The antenna unit includes one or more antennas, each having an electrical radio frequency (RF) connection to the radio system via a non-conductive coupling through the enclosure.

An antenna unit in accordance with one or more embodiments is provided for use in a radio communications device. The radio communications device includes a base unit having an enclosure and a radio system inside the enclosure. The antenna unit comprises a dielectric support having one or more antennas thereon. The support is detachably connectable to the enclosure of the base unit. Each antenna includes a coupling feature configured to provide an electrical RF connection to the radio system via a non-conductive coupling through the enclosure when the antenna unit is attached to the base unit.

BRIEF DESCRIPTION OF THE DRAWINGS

Like or identical reference numbers are used to identify common or similar elements.

DETAILED DESCRIPTION

Various embodiments disclosed herein are directed to radio communications devices having detachable external antenna. Such devices can be used for various purposes including providing connectivity to networks using WiMAX and other telecommunications protocols.

Figure 1:
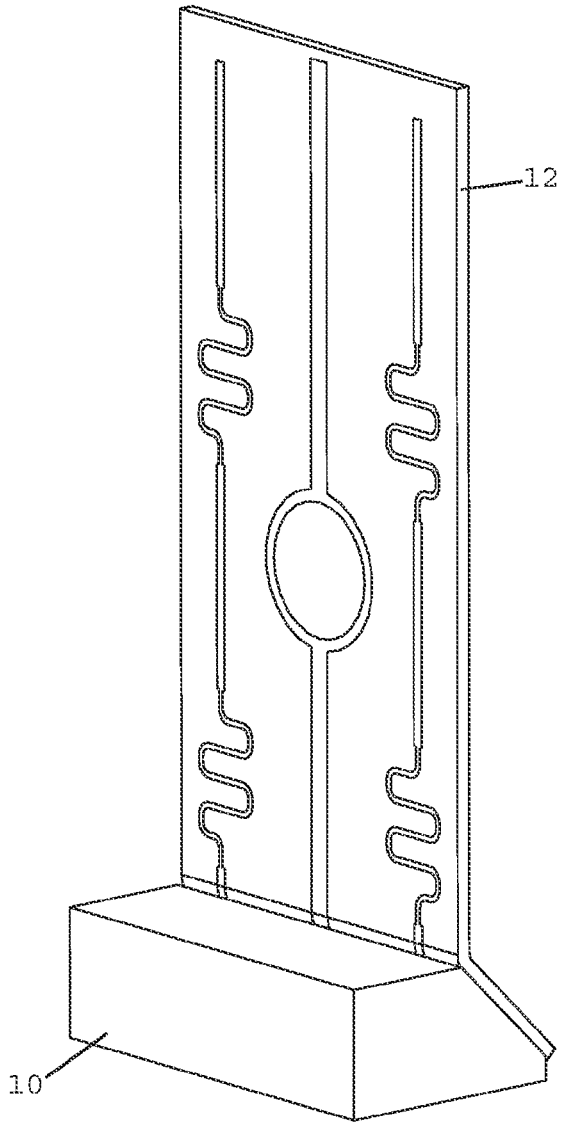
FIG. 1 is a perspective view of an exemplary radio communications device having a detachable antenna unit in accordance with one or more embodiments.
Figure 2:
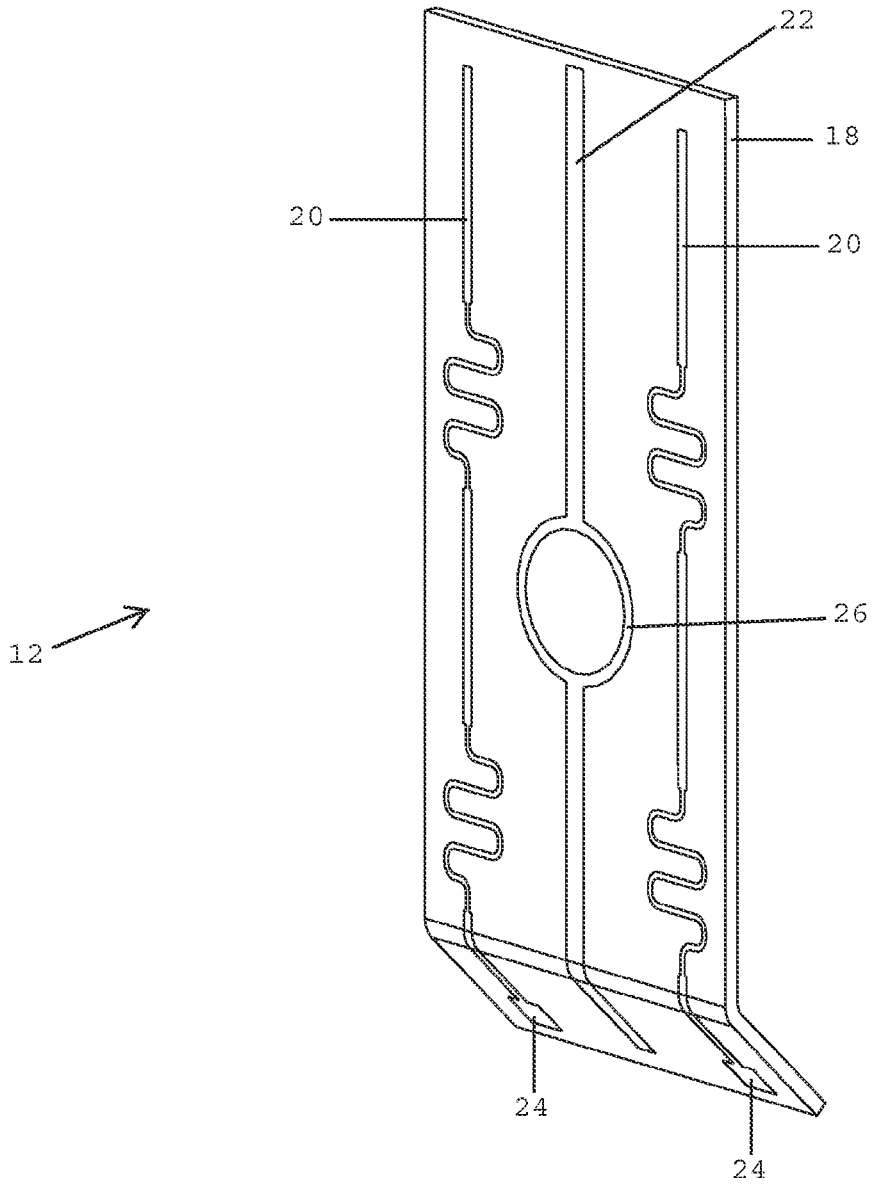
FIG. 2 is a perspective view of the antenna unit.
Figure 3:
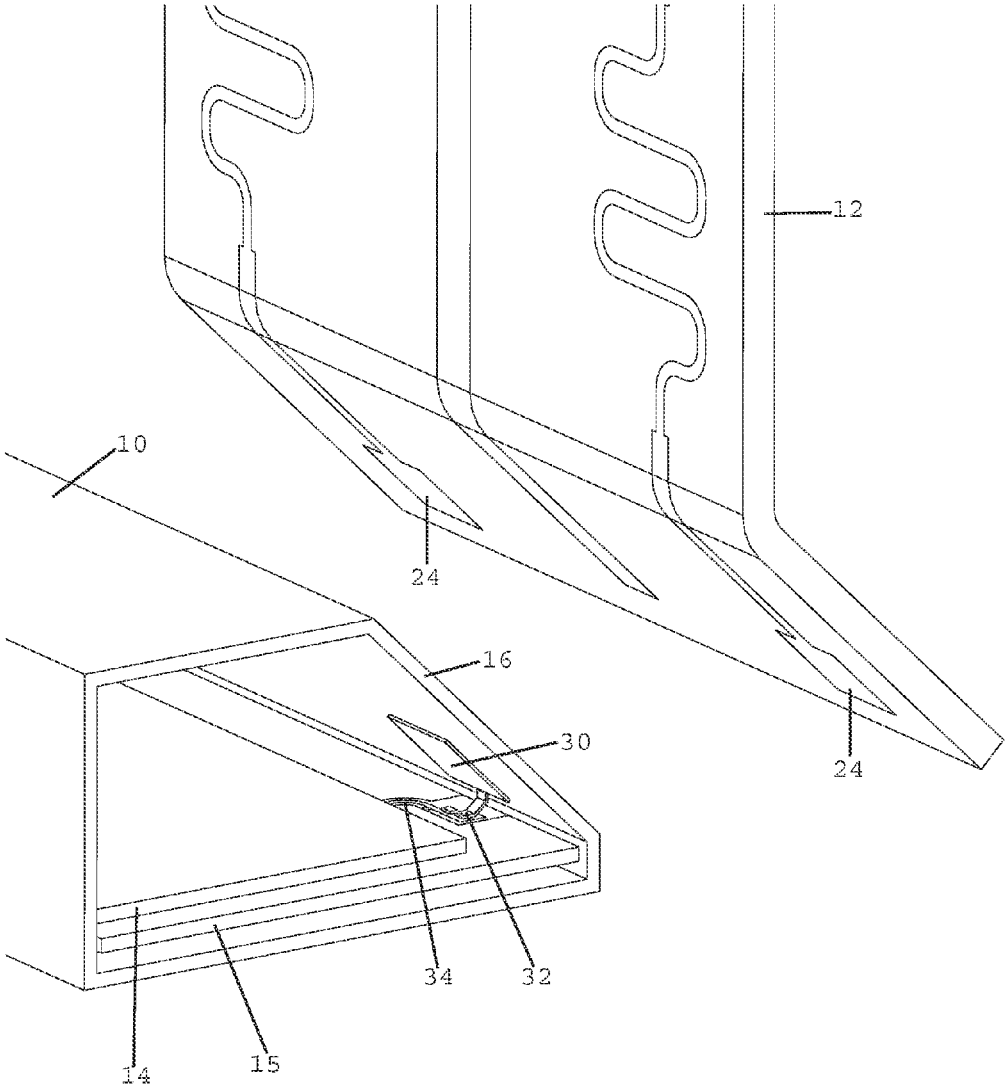
FIG. 3 is a close-up perspective view illustrating the connection of the antenna unit and base unit of the radio communications device.

FIGS. 1-4 illustrate an exemplary radio communications device having a detachable antenna section in accordance with one or more embodiments. The device includes a base 10 and an external antenna section 12 that is detachable from the base. As shown in FIG. 3, the base 10 includes radio communications electronics 14 on a base printed circuit board (PCB) 15 configured for sending and receiving radio frequency (RF) signals.

The electronics 14 are housed within a plastic enclosure 16 of the base 10. The antenna section 12 can be removably affixed to the base enclosure 16 by various connection techniques including, e.g., mechanical fasteners, interference fits, snap or groove features integrated into the base enclosure 16 and antenna section 12, adhesives, and magnets. The electrical RF connection between the radio and the antennas in the antenna section is made via a capacitive coupling through the wall of the enclosure 16. Accordingly, no metallic or galvanic connection is needed from the radio electronics 14 or PCB 15 through the enclosure wall to the antenna section 12.

As shown in FIG. 2, the antenna section comprises a plastic or polycarbonate dielectric support 18 having an electrical conductive pattern forming a desired antenna function. The conductive pattern defines one or more antennas 20. Each antenna 20 includes an integrated coupling feature for connection to the radio electronics. The conductive pattern can also include other functional features such as antenna directors, reflectors, or baluns, as well as non-functional features such as cosmetic shapes or logos.

In the exemplary embodiment, the conductor pattern defines two antennas 20 separated by a reflector element 22. The antennas 20 are end-fed collinear dipole arrays comprising three half-wave dipole sections connected by inductive delay sections. Various other antenna configurations are also possible. The bottom end of each antenna 20 includes a small plate 24 that serves as a coupling feature. The reflector 22 increases the directivity and isolation between the two antennas 20, and also includes a decorative ring feature 26. Various other functional and decorative features (including, e.g., other patterns and logos) are also possible.

The conductor pattern is applied to one surface of the supporting piece 18. The conductive pattern may be applied to the supporting piece 18 by a number of methods including, but not limited to, screen or pad printing, copper plating techniques, direct sputtering or deposition techniques, or by bonding a flexible printed circuit sheet or decal containing the desired pattern to the support.

Figure 4:
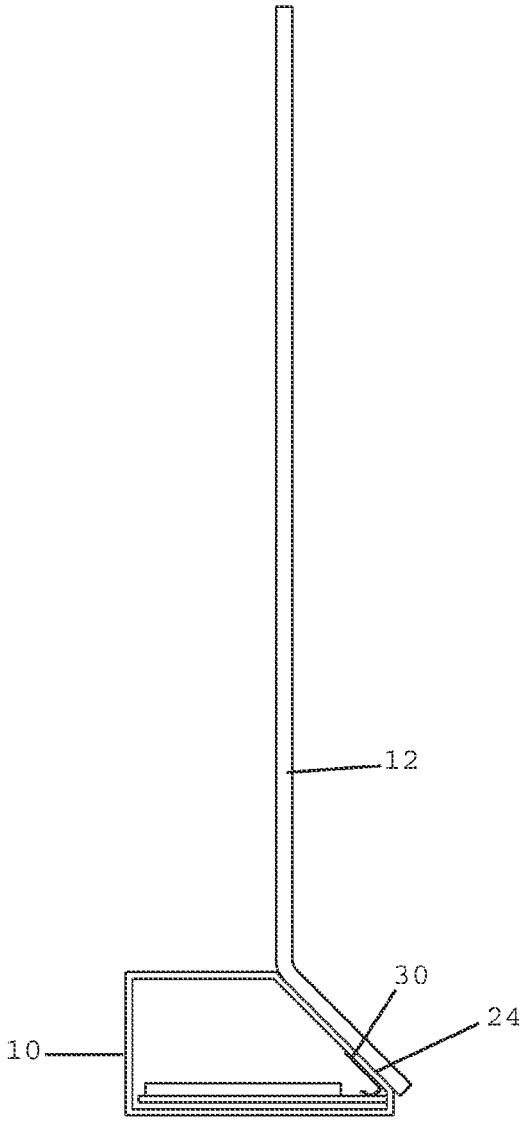
FIG. 4 is a side view of the radio communications device.

The coupling feature 24 on each antenna 20 aligns with a similar corresponding feature 30 on the inside of the base enclosure 16 as illustrated in FIGS. 3 and 4. In the exemplary embodiment, each base coupling feature 24 comprises a plate (with dimensions generally matching those of the corresponding antenna coupling plate 24) and a smaller tab 32 to make contact to the PCB 15 within the base 10. The base coupling plate 30 can be formed from stamped metal such that the tab 32 may act as a spring contact to mate to an exposed pad on the PCB 15. The RF connection to the radio is provided by a transmission line such as a microstrip line 34 on the PCB 15 or by a section of jumper coaxial cable, nominally 50 ohms. Impedance transformation or matching features can be included before the base coupler plate to match the transmission line impedance to the impedance seen at the input to the coupler. In the exemplary embodiment, a shunt inductor is used to transform the high input impedance to a suitable 50-ohm match.

In accordance with one or more alternate embodiments, the non-conductive coupling for transmission of RF signals to each antenna in the antenna section may be an inductive coupling at radio frequency.

FIGS. 5-8 show measured performance of the exemplary embodiment referenced from measurement points at the inputs to the base coupling plates inclusive of the matching shunt inductors.

Figure 5:
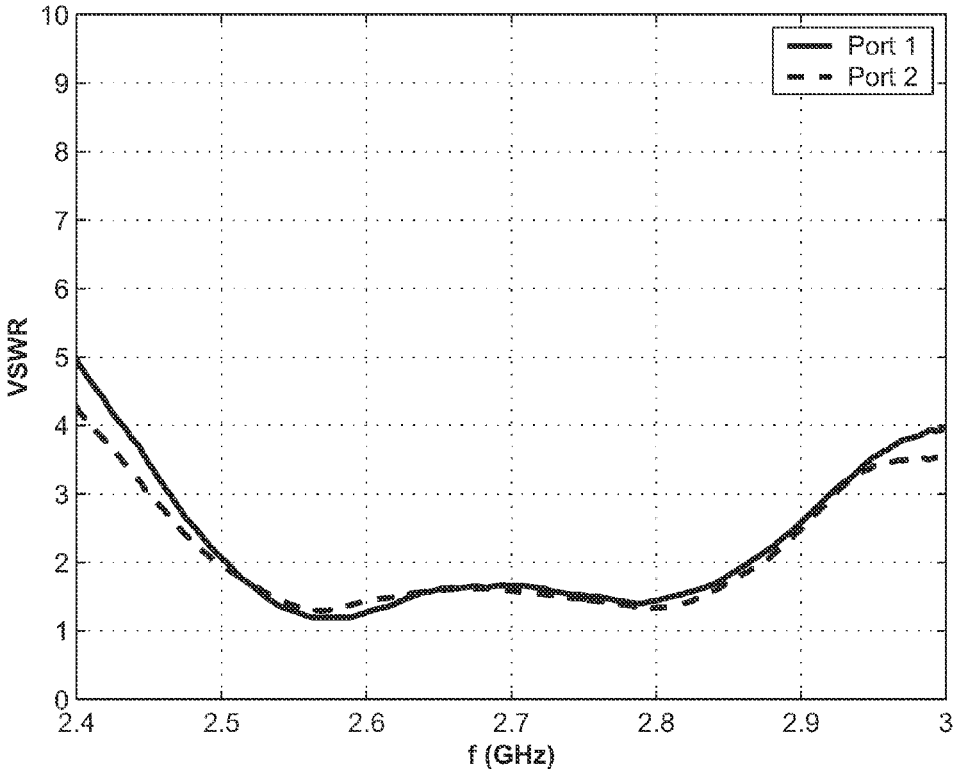
FIG. 5 is a graph illustrating a VSWR plot for each antenna of an exemplary antenna unit in accordance with one or more embodiments.

FIG. 5 is a plot of the VSWR for each antenna.

Figure 6:
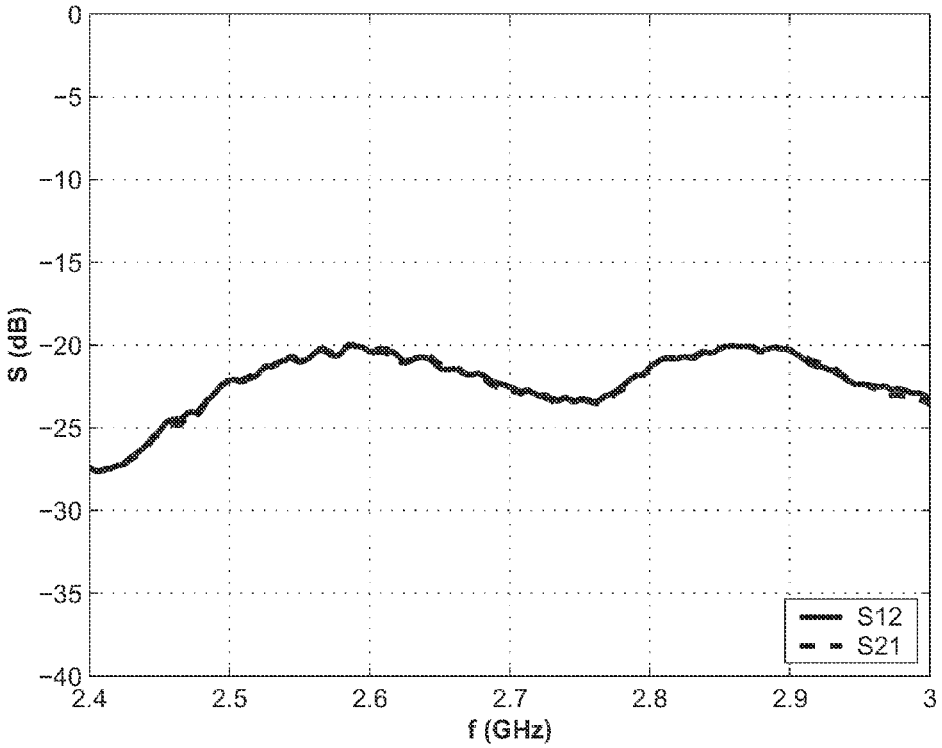
FIG. 6 is a graph illustrating coupling between the measurement points at the inputs of the antenna unit.

FIG. 6 is a plot of the coupling between the measurement points.

Figure 7:
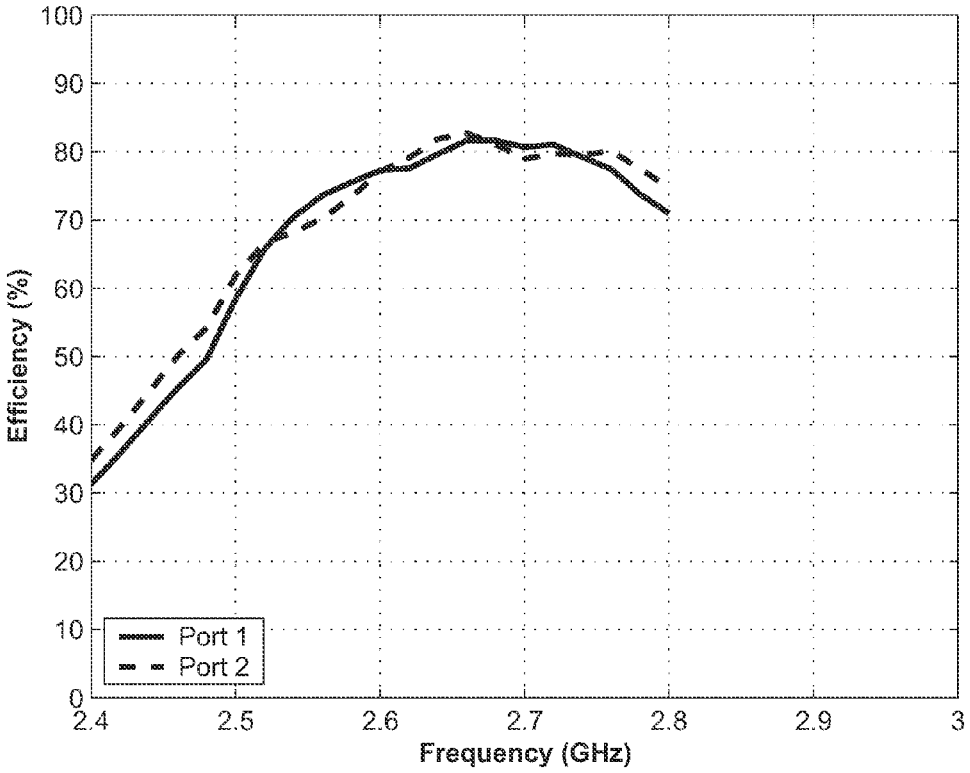
FIG. 7 is a graph illustrating realized radiation efficiency for each antenna in the antenna unit.

FIG. 7 is a plot of the realized radiation efficiency for each antenna.

Figure 8:
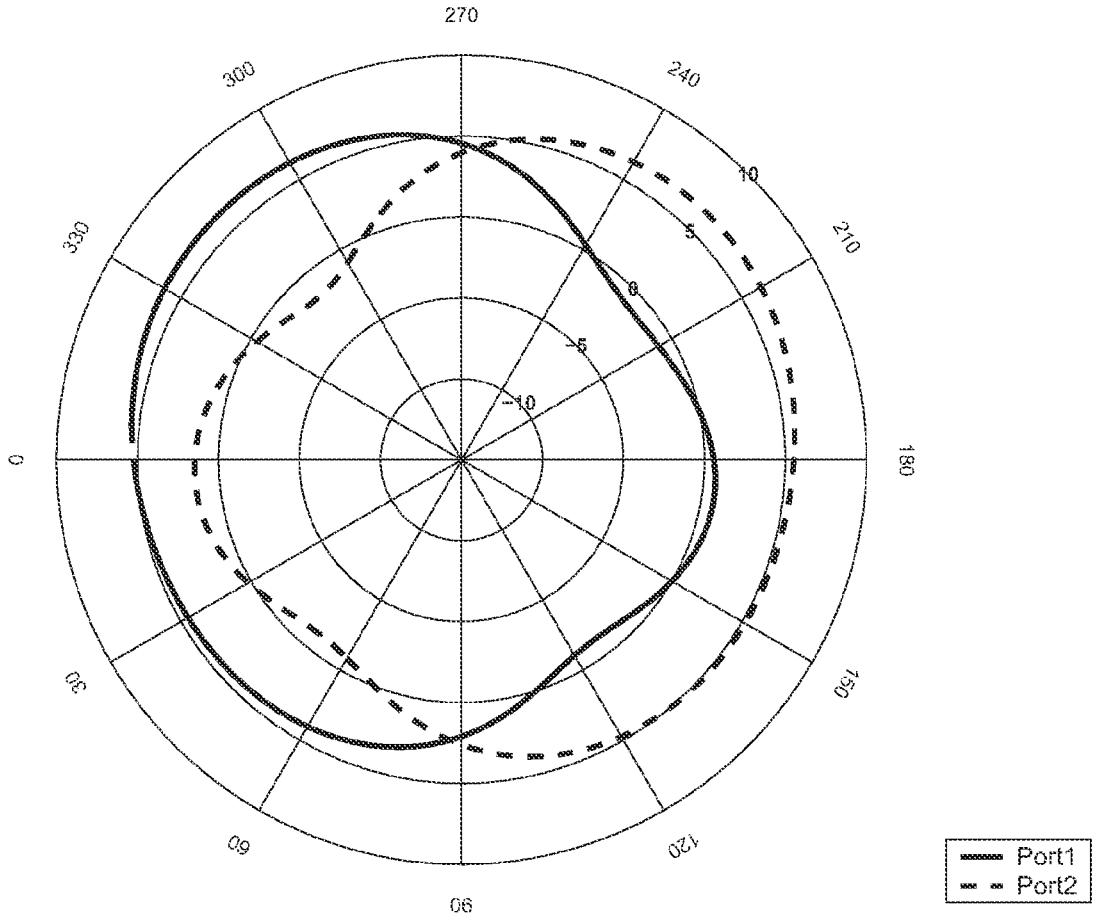
FIG. 8 is a graph illustrating the azimuthal radiation gain pattern for each antenna in the antenna unit.

FIG. 8 is a plot of the azimuthal radiation gain pattern for each antenna.

One advantage of having an antenna section that is detachable from a base radio unit is that it is possible for a user to easily replace either item if needed, e.g., in the event either the base or the antenna section is damaged or requires upgrading.

Using a capacitive, non-conductive coupling for transmission of RF signals to each antenna allows for a simpler assembly process that can avoid use of soldering or cable attachment. Additionally, the capacitive coupling can eliminate the need for metal-to-metal contact and thereby reduces wear between the parts, allowing the coupling to be able to withstand many more install and remove cycles. In addition, by avoiding metal-to-metal contact, the performance of the device can be more consistent over the life of the product. Furthermore, avoiding metal-to-metal contact reduces the possibility of corrosion and oxidation, particularly if the coupling features are embedded in or covered with plastic.

In accordance with one or more further embodiments, the dielectric support 18 of the antenna section 12 is transparent or translucent, and can be edge lighted, either from the base or one or more sides. In some embodiments, the antennas 20 are made to contrast the support. In other embodiments, the antennas 20 can leak light and appear self luminous if made transparent, translucent, or from a mesh conductor. Other visual effects may be created using a light scattering decal or by an etched logo or pattern on the plastic support. Thus, the antenna section 12 can be made to form an attractive display that is both functional as an antenna and as a luminous display.

Having thus described illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments.

Additionally, elements and components described herein may be further divided into additional components or joined together to form fewer components for performing the same functions.

Accordingly, the foregoing description and attached drawings are by way of example only, and are not intended to be limiting.

What is claimed is:

1. A radio communications device, comprising:

a base unit including an enclosure and a radio system inside the enclosure; and an antenna unit detachably connected to the enclosure of the base unit, said antenna unit including one or more antennas, each having an electrical radio frequency (RF) connection to the radio system via a non-conductive coupling through the enclosure, wherein the antenna unit comprises a dielectric support having an electrical conductive pattern disposed thereon defining the one or more antennas, and wherein the electrical conductive pattern further defines an antenna director, reflector, balun on the dielectric support, an ornamental feature on the dielectric support, or two antennas separated by a reflector element on the dielectric support.

2. The device of claim 1, wherein the antenna unit is detachably connected to the base unit using a mechanical fastener, an interference fit mechanism, a snap mechanism, a groove feature, an adhesive, or a magnet.

3. The device of claim 1, wherein the electrical conductive pattern is applied to a surface of the dielectric support by screen or pad printing, plating, direct sputtering, or deposition, or by bonding a flexible printed circuit sheet or decal containing the pattern to the surface.

4. The device of claim 1, wherein each of the one or more antennas includes an antenna coupling element at an end thereof proximate the base unit, and the base unit includes one or more base unit coupling elements connected to the radio system, each base unit coupling element corresponding to and aligned with an antenna coupling element to provide a capacitive, non-conductive coupling of each antenna to the radio system.

5. The device of claim 4, wherein each antenna coupling element and each base unit coupling element comprises a plate.

6. The device of claim 5, wherein each base unit coupling element further comprises a tab connected to the plate, wherein said tab forms a spring contact to mate with a printed circuit board portion of the radio system.

7. The device of claim 1, wherein the non-conductive coupling for transmission of RF signals to each antenna in the antenna unit comprises an inductive coupling at radio frequency.

8. The device of claim 1, wherein each of the one or more antennas comprises end-fed collinear dipole arrays comprising three half-wave dipole sections connected by inductive delay sections.

9. The device of claim 1, wherein the antenna unit comprises a transparent or translucent dielectric support that is edge lighted.

10. The device of claim 9, wherein each of the one or more antennas is transparent, translucent, or made from a mesh conductor such that each antenna appears self luminous when the antenna unit is lighted.

11. The device of claim 9, further comprising a light scattering decal or an etched marking on the dielectric support to create a given visual effect when the antenna unit is lighted.

12. An antenna unit for use in a radio communications device, said radio communications device including a base unit having an enclosure and a radio system inside the enclosure, said antenna unit comprising:

a dielectric support having one or more antennas thereon, said support being detachably connectable to the enclosure of the base unit, each antenna including a coupling feature configured to provide an electrical radio frequency (RF) connection to the radio system via a non-conductive coupling through the enclosure when the antenna unit is attached to the base unit, wherein the antenna unit comprises a dielectric support having an electrical conductive pattern disposed thereon defining the one or more antennas, and wherein the electrical conductive pattern further defines an antenna director, reflector, balun on the dielectric support, an ornamental feature on the dielectric support, or two antennas separated by a reflector element on the dielectric support.

13. The antenna unit of claim 12, wherein the support can be detachably connected to the base unit using a mechanical fastener, an interference fit mechanism, a snap mechanism, a groove feature, an adhesive, or a magnet.

14. The antenna unit of claim 12, wherein the electrical conductive pattern is applied to a surface of the dielectric support by screen or pad printing, plating, direct sputtering, or deposition, or by bonding a flexible printed circuit sheet or decal containing the pattern to the surface.

15. The antenna unit of claim 12, wherein each of the one or more antennas includes an antenna coupling element at an end thereof proximate the base unit, and the base unit includes one or more base unit coupling elements connected to the radio system, each base unit coupling element corresponding to and aligned with an antenna coupling element to provide a capacitive, non-conductive coupling of each antenna to the radio system.

16. The device of claim 15, wherein each antenna coupling element and each base unit coupling element comprises a plate.

17. The antenna unit of claim 12, wherein the non-conductive coupling for transmission of RF signals to each antenna in the antenna unit comprises an inductive coupling at radio frequency.

18. The antenna unit of claim 12, wherein each of the one or more antennas comprises end-fed collinear dipole arrays comprising three half-wave dipole sections connected by inductive delay sections.

19. The antenna unit of claim 12, wherein the antenna unit comprises a transparent or translucent dielectric support that is edge lighted.

20. The antenna unit of claim 19, wherein each of the one or more antennas is transparent, translucent, or made from a mesh conductor such that each antenna appears self luminous when the antenna unit is lighted.

21. The antenna unit of claim 19, further comprising a light scattering decal or an etched marking on the dielectric support to create a given visual effect when the antenna unit is lighted.

22. The antenna unit of claim 12, wherein the dielectric support comprises a plastic or polycarbonate material.

* * * * *